US007395585B2

(12) United States Patent
Longley et al.

(10) Patent No.: US 7,395,585 B2
(45) Date of Patent: Jul. 8, 2008

(54) BUCKLE ASSEMBLY

(75) Inventors: Rosemary A. Longley, Grosse Pointe Woods, MI (US); Janet K. Gravelle, Macomb Township, MI (US); Lawrence M. Refior, Romeo, MI (US); Carl M. Petersen, III, Waterford, MI (US); Amit Sharma, Rochester Hills, MI (US); Caryn F. Carter, Lake Orion, MI (US); Tony Jain, Rochester Hills, MI (US)

(73) Assignee: Key Safety Systems, Inc, Steeling Heights, MI (US)

( * ) Notice: Subject to any disclaimer, the term of this patent is extended or adjusted under 35 U.S.C. 154(b) by 22 days.

(21) Appl. No.: 11/234,369

(22) Filed: Sep. 23, 2005

(65) Prior Publication Data

US 2007/0044283 A1 Mar. 1, 2007

Related U.S. Application Data

(60) Provisional application No. 60/710,935, filed on Aug. 24, 2005.

(51) Int. Cl.
*A44B 11/25* (2006.01)

(52) U.S. Cl. ..... 24/633

(58) Field of Classification Search ..... 24/633, 24/641, 642, 629
See application file for complete search history.

(56) References Cited

U.S. PATENT DOCUMENTS

| | | | | | |
|---|---|---|---|---|---|
| 4,408,373 | A * | 10/1983 | Miskowicz | ..... | 24/664 |
| 4,614,010 | A * | 9/1986 | Charlton et al. | ..... | 24/639 |
| 4,928,366 | A * | 5/1990 | Ballet | ..... | 24/641 |
| 4,949,436 | A * | 8/1990 | Anscher | ..... | 24/671 |
| 5,377,393 | A * | 1/1995 | Ellis | ..... | 24/637 |
| 6,386,496 | B1 * | 5/2002 | Lai et al. | ..... | 248/309.1 |

* cited by examiner

*Primary Examiner*—Robert J Sandy
(74) *Attorney, Agent, or Firm*—Markell Seitzman

(57) ABSTRACT

A seat belt buckle assembly (20) having: a locking assembly (22) and an integrally formed cover (26) to receive the locking assembly, the locking assembly and cover having a plurality of guiding and stabilizing members (160, 100, 110, 190, 109, 194, 150, 70*a,c*) configured to prevent specific relative motion between the cover and the locking assembly.

15 Claims, 8 Drawing Sheets

BUCKLE ASSEMBLY

BACKGROUND AND SUMMARY OF THE INVENTION

This application claims the benefit of U.S. Provisional Application 60/710,935 filed on Aug. 24, 2005. The disclosure of the above application is incorporated herein by reference.

The present invention relates to a seat belt buckle assembly comprising an improved interrelationship between a buckle cover and a frame of the buckle assembly.

It is an object of the present invention to provide an improved seat belt buckle assembly.

Accordingly the invention comprises: a seat belt buckle assembly comprising: a locking assembly and an integrally formed, one-piece cover to receive the locking assembly, the cover and locking assembly include a plurality of guiding and stabilizing members configured to guide the locking frame and the cover into a preferred orientation and to prevent relative motion between the cover and the frame.

Many other objects and purposes of the invention will be clear from the following detailed description of the drawings.

DETAILED DESCRIPTION OF THE DRAWINGS

Figure 1:
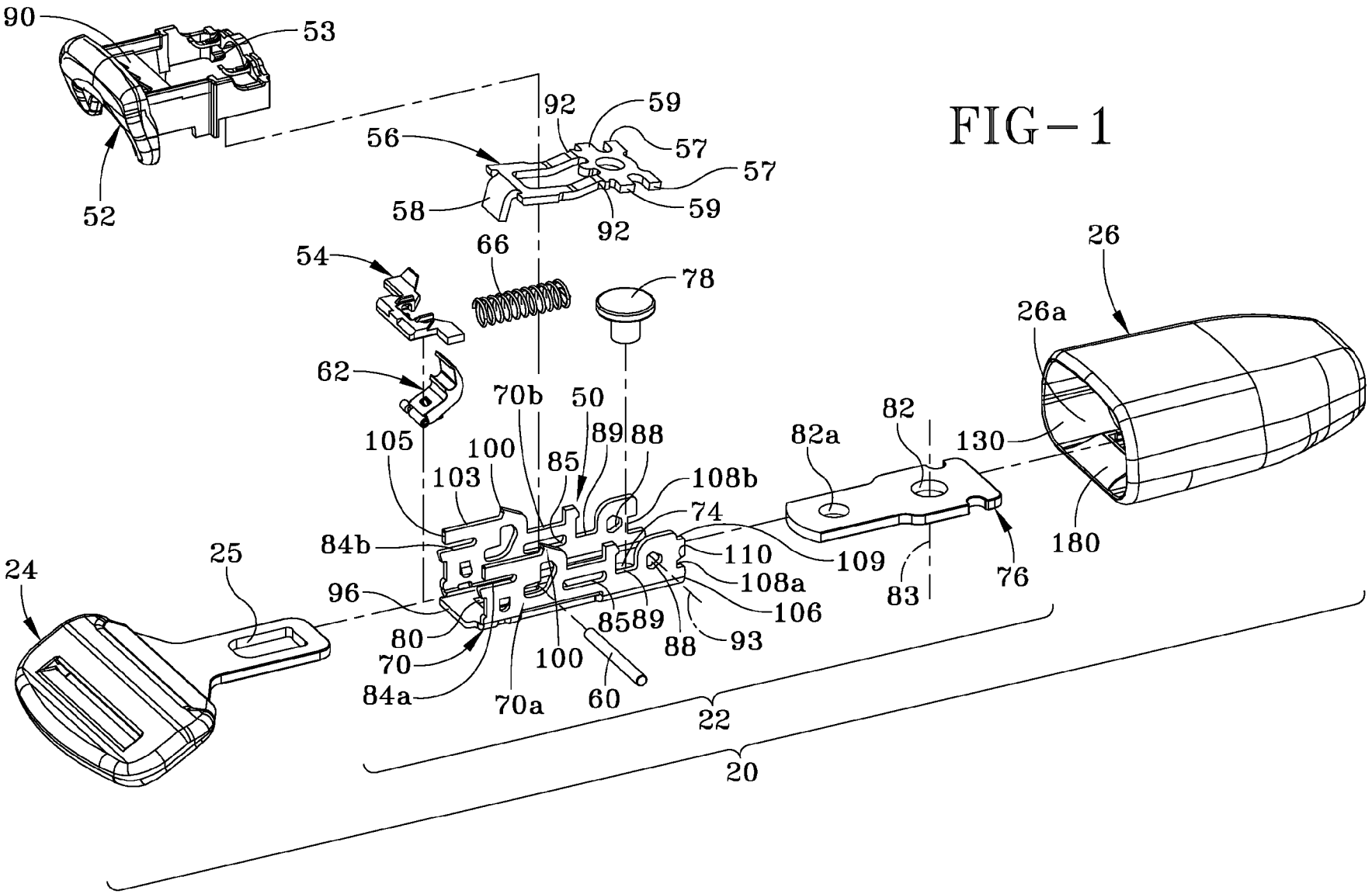
FIG. 1 is an exploded view showing the major components of the present invention.
Figure 2:
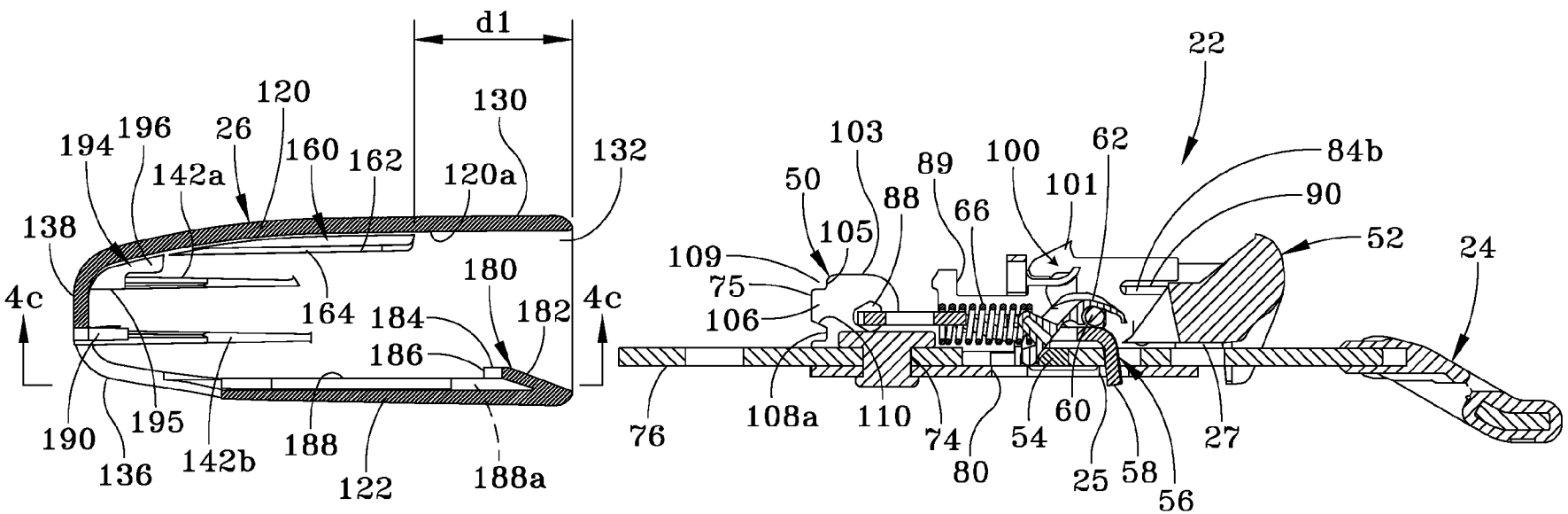
FIG. 2 is another exploded view showing a cover displaced from a completed locking assembly.

Reference is made to FIGS. 1 and 2, each of which is an exploded view of the present invention. The buckle assembly (also referred to as a buckle) 20 generally comprises a locking assembly 22 and a one-piece (preferably plastic) cover 26, which receives the locking assembly. A mating tongue 24 cooperates with the buckle assembly and is received within the locking assembly. Many of the features of the current locking assembly 22 are shown in U.S. Pat. No. 4,451,958, which is incorporated herein by reference. The locking assembly comprises a U-shaped base or frame 50 defining, in concert with a release button 52, a path 27 (between the frame and an underside of the button—see FIG. 2) for the tongue 24. The tongue 24 includes an aperture (lock aperture) 25 that is selectively lockingly engaged by a latch element (also referred to as a lock element) of the locking assembly 22.

The locking assembly further includes an ejector 54 (which pushes the tongue out of the locking assembly), a tilting or rotatable locking element 56 with a projecting catch, tip or projection 58 receivable within the tongue aperture 25, a retaining element 60 configured as a bar for holding the latch element in place in its lock position, a rocker 62 that slides over the retaining element and places pressure upon the retaining element 60 and is hinged upon the ejector 54, and a single compression spring 66 cooperating with the rocker to bias the rocker and provide a bias force acting on the ejector 54. The arrangement and operation of the above elements are substantially the same as described in the above-referenced patent.

Historically, the locking assembly 22 in the above buckle 20 was received within and protected by a two-part plastic molded cover. This cover included two mating cover parts that interlatched with each other. Subsequently, the two mating cover parts, along mating faces, were sonically welded together. The utilization of a two-part cover complicates the buckle assembly process requiring the locking assembly to be first placed in a first one of the cover parts such as the lower cover and held in place, and then the other cover part such as the upper cover is carefully placed upon the locking assembly and the lower cover and secured in place. Plastic parts such as the prior cover, having a mating line, are susceptible to delatching along this mating line. Further, the dimensions of these prior two cover parts need to be precisely controlled to ensure a proper fit and finish therebetween, to properly hold the locking assembly in place, as well as to enhance the aesthetic styling of the cover, as an uneven mating line or seam is not aesthetically pleasing.

The use of a one-piece buckle cover of the present invention permits the tighter fit between the cover and the frame, eliminating rattle. Further, the one-piece cover has greater structural integrity than the prior art multi-piece cover; it is more pleasing to the eye as it does not have a seam and only one tool (as opposed to two) is needed to manufacture the cover, which contributes to achieving the tighter clearances between the various parts of the buckle 20.

Figure 3:
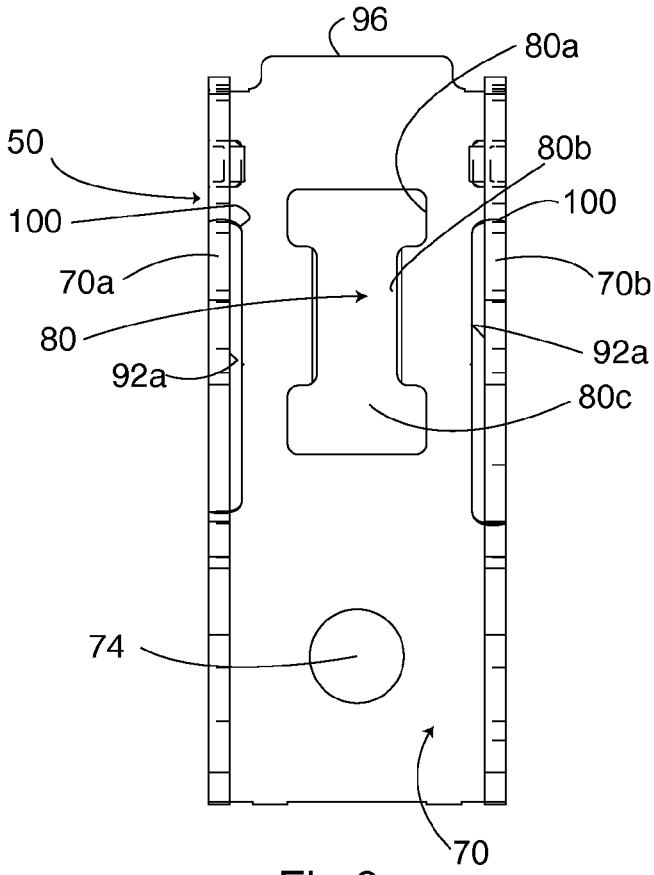
FIG. 3 is a top view of a frame.

The frame 50 includes various features to retain the ejector 54, latch element 56 and release button 52, and contains other features that permit the frame to be received by, secured to and properly aligned within the one-piece cover of the present invention. The frame 50 is made of a metal stamping and comprises a bottom 70 and sides 70*a* and 70*b*. The bottom 70 includes an aperture 74 (see FIG. 3), which permits connection to a strap 76 through a fastener such as a rivet (double-headed) 78 (see FIGS. 1 and 2). The bottom 70 further includes a shaped-stepped opening 80 having an enlarged portion 80*a* to receive the catch 58 (also shown in FIG. 2), a narrow opening 80*b* and another enlarged portion 80*c*.

The strap 76 effectively extends the size of the frame and provides a bridge or connector to a vehicle mounting structure (such as a vehicle seat). The frame can also be attached to a secondary strap device such as mounting cable or length of seat belt webbing (which also functions loosely or flexibly mounts the buckle to a vehicle mounting structure). The strap 76 can take many shapes. As illustrated, the strap includes a first opening 82 into which is received a fastener such as a shoulder bolt (not shown) permitting a rotatable connection to the vehicle mounting structure and another opening 82*a*, which receives the rivet. Numeral 83 shows a central axis of the shoulder bolt. If a shoulder bolt is used the buckle assembly 20 is rotatable about the axis 83 of the shoulder bolt to different positions; this type of connection is known in the art.

The strap opening 82 need not to be circular; for example, opening 82 can be oval. A rivet can be received in opening 82 to receive a length of seat belt webbing and a cable can be secured about the rivet. These mounting relationships are generally known in the art.

Figure 3A:
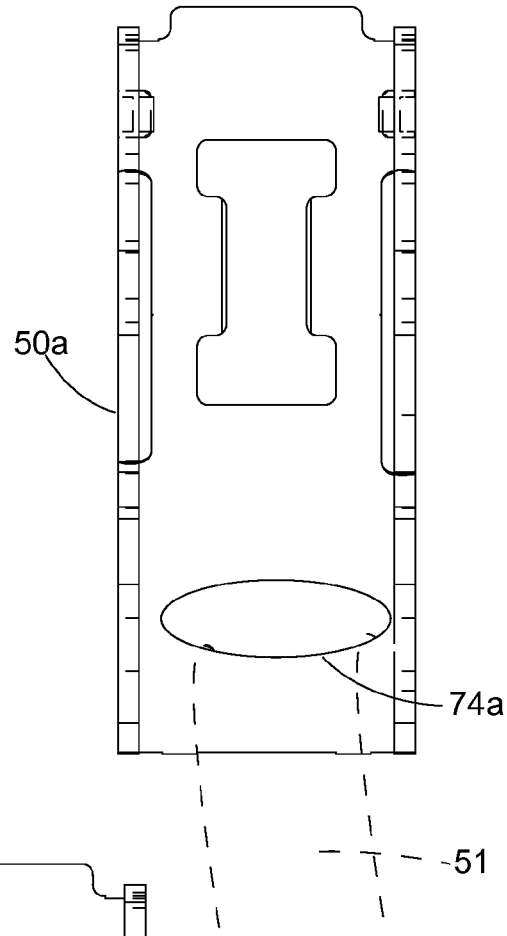
FIG. 3*a* shows an alternate embodiment of the frame suitable for connection to a piece of seat belt webbing.
Figure 3B:
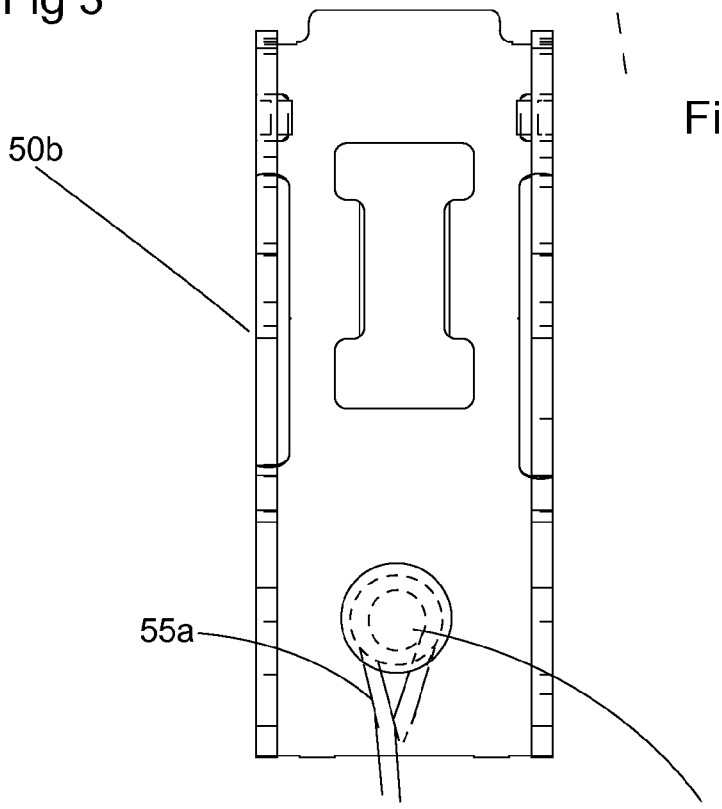
FIG. 3*b* shows an alternate embodiment of the frame suitable for connection to a length of cable.

Reference is briefly made to FIG. 3*a*, which shows a variation of the frame 50*a*suitable for use when connecting the frame to a piece of seat belt webbing 51. The circular opening 74 has been replaced with the oval opening 74*a*. An end of the seat belt webbing (not shown) is pushed through opening 74*a*, folded over and sewn to itself. FIG. 3*b* shows another frame 50*b* having a rivet 55 or other fastener about which a cable 55*a* is looped.

The frame 50 (or 50*a* or 50*b*) includes features to retain the release button 52. More particularly, each forward part of frame side 70*a* and 70*b* includes a slot 84*a* and 84*b*, each of which receives a portion of a ledge or plate 90 formed on the button 52 (also see FIG. 2). Each side 70*a* and 70*b*, generally near the middle, includes an elongated groove 85. Each groove 85 receives a projection or leg 53 formed on a respective inner end of the button 52. Opposed openings 88 in the frame 50 each receive a leg 57 of latch element 56; the legs 57, in cooperation with openings 88, form a pivot axis 93 about which the locking element rotates between a locked and an unlocked position. The frame also includes opposing open-topped slots 89, each one of which receives another leg of the latch element 56. The latch element 56, proximate legs 59, includes opposing projections 92, which provide for point-contact locations between the latch element 56 and an interior wall 92*a*of the frame 50. The latch element is movably received within the frame; these projections limit side-to-side lateral motion of the latch element along axis 93. The small contact area of the projections 92 also reduces friction between the latch element and the inner walls 92*a*of the frame.

The frame 50, in addition to the features mentioned above, also includes an integrally formed, interfering formation 100 (also referred to as a pointed barb 101) proximate the top of each side 70*a*and 70*b*. As will be seen from the description below, these formations 100 bite into and deform a cooperating formation 160 on a top inside surface of the button cover 26 and prevent the cover 26 from moving fore and aft as well as side-to-side on the frame. Further, formation 160 is effective during assembly to center the frame and cover relative to one another. The forward end 96 of frame 50 is formed with a flat profile as more clearly shown in FIG. 3.

As can be seen from the FIG. 1, the frame 50 proximate a rear portion of each frame side 70*a*and 70*b*includes a respective horizontally extending notch or groove 108*a*and 108*b*. Each groove 108*a*and 108*b*is located above the frame bottom 70 proximate end 106 of the button. One or both of grooves 108*a*and 108*b*include an inclined top surface 110. In the preferred embodiment only groove 108*a*includes the inclined top surface 110 giving groove 108*a*a somewhat trapezoidal shape. Groove 108*b*, as illustrated, has generally square corners and a square shape; however, groove 108*b* can also have the shape of groove 108*a*. Further, the frame 50 includes at least one additional notch, groove or shoulder 109 located on the top of a frame side such as 108*a*at the rear 106 of the frame. The notch (groove or shoulder) 109, in cooperation with a portion of the cover, prevents upward movement of the frame 50 when installed with the cover 26.

Reference is now made to FIGS. 1, 2, 4-4*b* and 5-5*e*, which show the various features of cover 26. The cover 26 includes a number of features, which in cooperation with features on the frame maintain the frame 50 at its desired alignment relative to the cover 26 during and after assembly. As can be seen from FIGS. 1, 4 and 5*b* the cover 26 is formed as a one-piece body and has four sides or, alternatively, a top 120, a bottom 122, first side 124 and second side 126. In cross-section the cover has a generally oval appearance (see FIG. 4*b*). The cover 26 is generally hollow and includes an open forward end or mouth 130 having an opening 132 formed by the cover, top, bottom and sides. The cover proximate a partial rear wall 138 has an opening 136. Opening 136 intersects the rear and bottom of the cover and not its top. The rear opening 136 extends from bottom 122, across the rear of each of the sides 124 and 126 and includes the lower portion of the rear wall 138.

Each of the cover sides 124 and 126, proximate the rear of the cover, includes a guide member generally shown by numeral 140, and in particular a pair of upper and lower guiding and stabilizing elements such as upper wall pair 142*a* and lower wall pair 142*b*. Each of the pairs of upper and lower walls 142*a* and 142*b* generally extends longitudinally, front-to-back and parallel to a longitudinal axis 144 (see FIG. 4*a*) of the cover 26.

Each wall 142*a* and 142*b* has a horizontally extending, obliquely or funnel shaped or tapered portion 150 located interior of the rear of the cover. The obliquely shaped or tapered portion 150 transitions to a horizontally extending axial portion 152 (parallel to axis 144) positioned rearward of portion 150. Obliquely shaped portion 150 guides the frame 50 toward the center (or the axis 144) of the cover during assembly. Each upper and lower wall 142*a* and 142*b* projects from one of the cover sides 124 or 126 and extends inwardly toward axis 144. The spacing between opposing axial wall portion 152 is substantially equal to the width W (see FIGS. 4*b* and 5*a*) of frame 50 and of strap 76. As more clearly shown in FIGS. 4 and 4*a*, each axial wall portion 152 is fabricated with a thin, deformable or crushable axially extending bead or rib 154. The ribs 154 located on each upper wall 142*a* are located near a lower surface 155 thereof, while the ribs 154 on each lower wall 142*b* are located near an upper surface 157 thereof. This orientation serves to stabilize and properly orient the sides 70*a* and 70*b* of the frame upon assembly.

Figure 4:
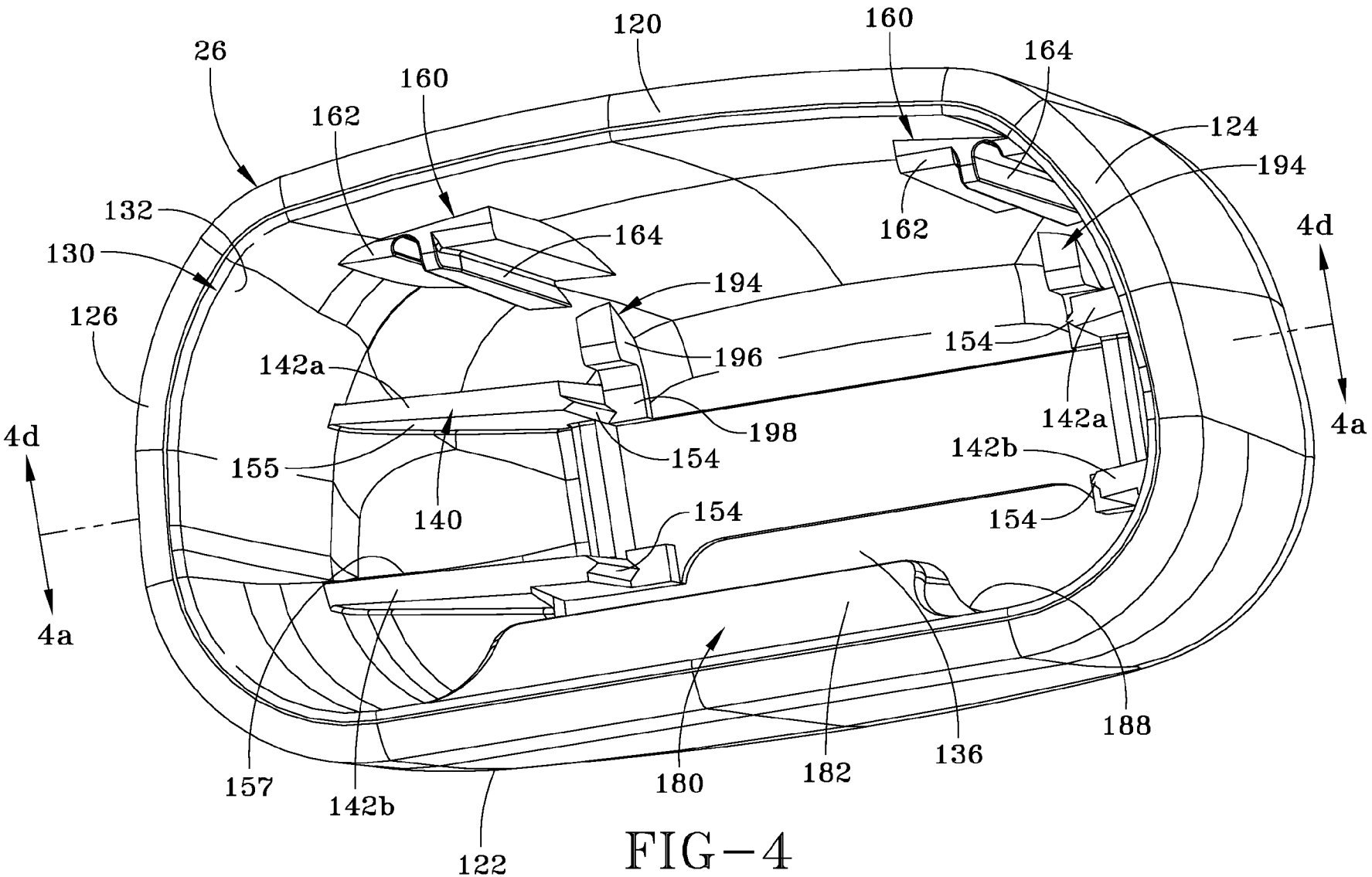
FIG. 4 is a front-isometric view of a buckle assembly cover.
Figure 4A:
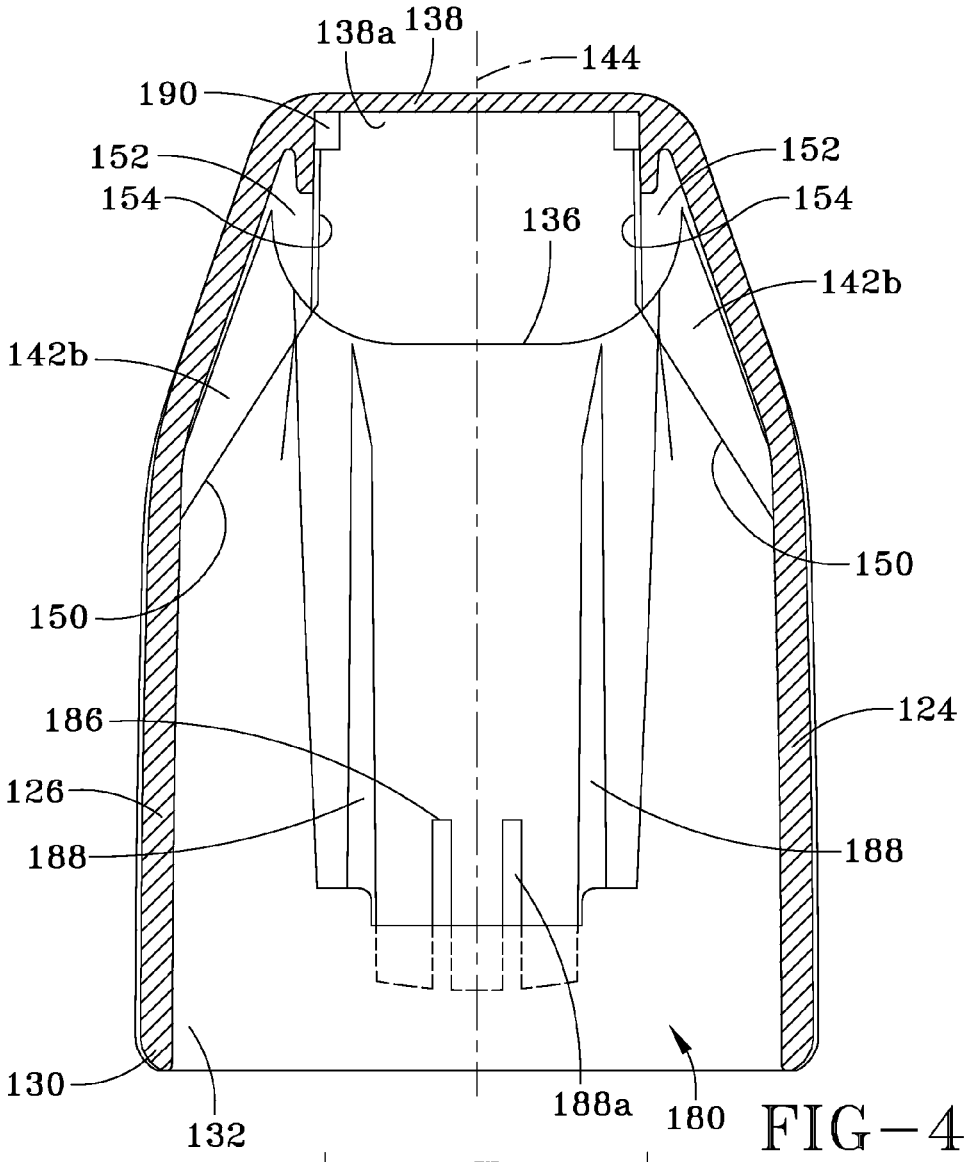
FIG. 4*a* is a cross-sectional view through Section 4*a*-4*a* of FIG. 4.
Figure 4B:
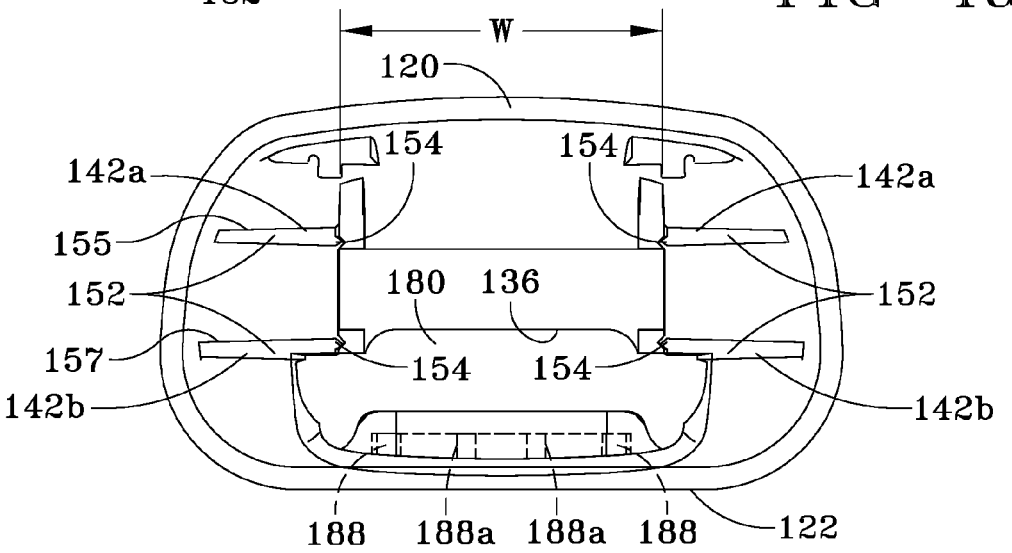
FIG. 4*b* is a front plan sectional view of the buckle assembly cover.
Figure 5:
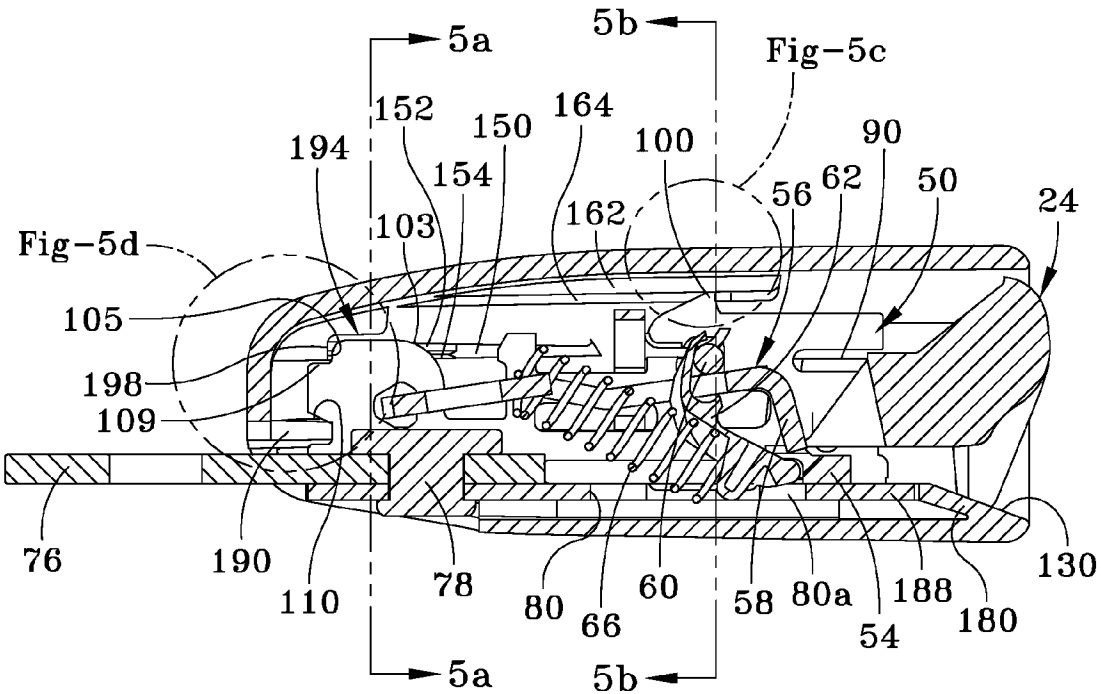
FIG. 5 is a cross-sectional view of an assembled buckle.
Figure 5A:
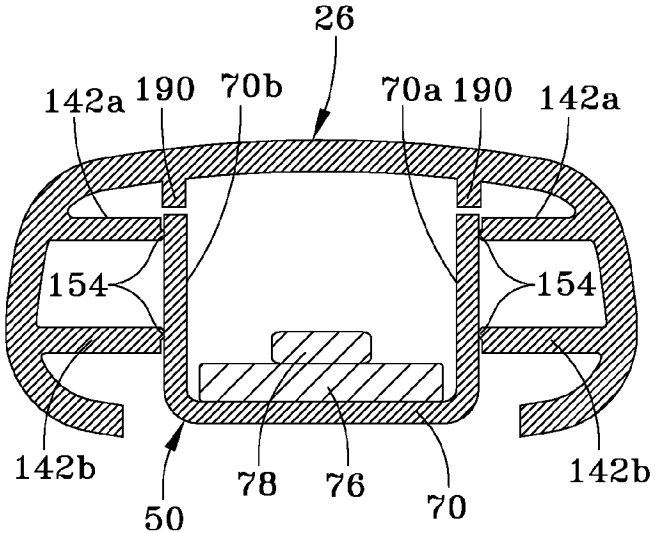
FIG. 5*a* is a cross-sectional view through section 5*a*-5*a* of FIG. 5.
Figure 5E:
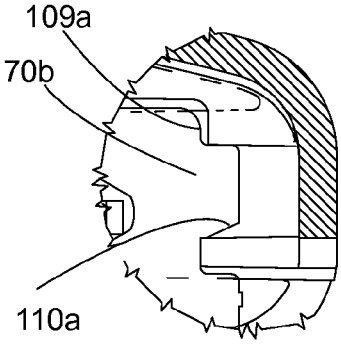
FIGS. 5*d* and 5*e* show enlarged views of selected portions of the buckle.
Figure 5D:
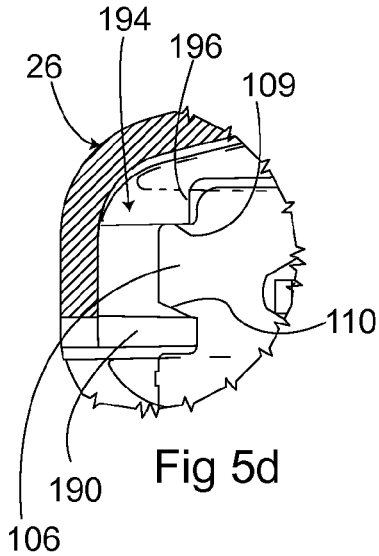
Figure 5C:
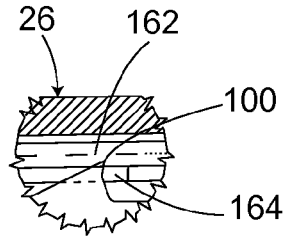
FIG. 5*c* is an enlarged view of a portion of FIG. 5.
Figure 5B:
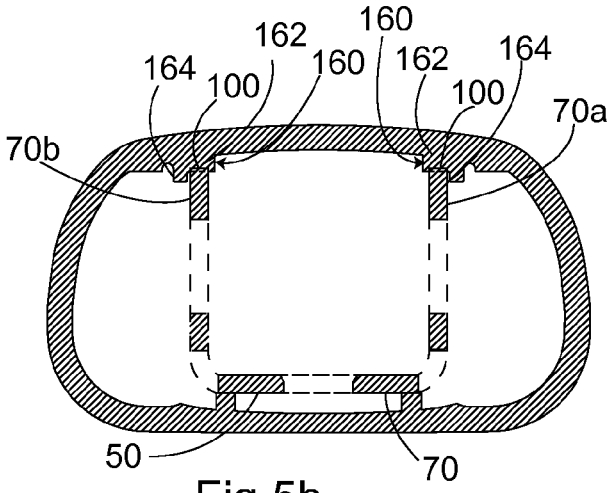
FIG. 5*b* is a cross-sectional view through section 5*b*-5*b* of FIG. 5.

As can be seen from FIGS. 4 and 5*b*, the underside 120*a*of top 120 includes two spaced-apart alignment and locking features. Each alignment and locking feature is identified by numeral 160. These alignment and locking features 160 are integrally formed within the cover and are located a dimension d1 from the front of the cover as illustrated in various figures; dimension d1 is keyed to the length of the frame 50. Each feature 160 includes a flat ridge 162 and a depending rib 164 (as shown in F*igure* 4). Each ridge 162 extends axially along the underside 120*a*of top 120. Each ridge is spaced apart from one another. Each rib 164 extends downward and is generally perpendicular to a corresponding ridge 162. Each ridge 162 and rib 164 is equally spaced on either side of axis 144. The spacing between the ribs is at a dimension W equal to the width of the frame 50. Upon assembly, locking features 100 of the frame 50 are guided laterally relative to axis 144 by the ribs 164. As the locking assembly 22 is moved (pushed or pulled) into the cover, both of the locking features 100 cut and lock into the material forming each flat ridge 162, as shown in FIG. 5*b*, and are stabilized side-to-side by the rib 164.

The bottom 122 of the cover 26 additionally includes lower guiding and locking formations. The bottom 122 includes a ramp 180 centrally positioned upon the bottom 122 at the mouth 130 of the cover 26. The forward surface 182 of the ramp is inclined and transitions to a horizontal flat section 184, which terminates in a vertical shoulder 186. When the frame 50 is in place within the cover as illustrated in FIG. 5, the forward end 96 of the frame 50 abuts shoulder 186. Shoulder 186 prevents the frame from moving forward relative to the cover (or vice versa). The bottom 122 additionally includes a set of two extending ribs 188. Each rib 188 extends from about shoulder 186 to the rear opening 136. The ribs 188 provide a raised, small area ramp upon which the frame (frame bottom) slides during assembly, maintaining alignment of the frame and the locking assembly 22 with the cover 26 after assembly. The bottom 122 additionally includes two short ribs 188*a*, positioned inboard of ribs 188 (see FIG. 4*b*), the purpose of which is to provide additional stability to the flat section 184 and shoulder 186.

The cover 26 includes an additional pair of locking and guiding features generally shown by numerals 190. Each of these locking and guiding features 190 is located on the inner surface 138*a* at the rear of the cover generally proximate the intersection of surface 138*a* with each of the axially extending wall portions 152 (also see FIG. 4*a*). Each guiding feature 190 is generally rectangular in shape. When contacted by the surface 108*a* of the metal frame 50, the guiding feature 190 will be deformed, fixing the relative position between the rear end of the frame and the cover. As mentioned, these locking and guiding features in general prevent the frame 50 from moving forward at shoulder 186 and side-to-side relative to the cover (or vice versa).

Reference is again made to FIGS. 2, 4 and 5, which show another set of upper guide features 194. Each guide feature extends inward from the undersurface or underside of the top 120*a* and the inner surface 138*a* of the rear of the cover 26. Each upper guide feature 194 is generally L-shaped and includes a triangular segment 196 that extends from the undersurface 122*a* and an extending leg portion 198 formed on the inner surface 138*a*. The respective upper guide features 194 are spaced apart from each other and include a receiving surface 195 (see FIGS. 2 and 6), which receives a horizontal 103 portion and a vertical 105 portion of the upper rear region of the frame 50 (see FIG. 1) and prevents these upper parts from moving upward relative to the cover 26.

Figure 6:
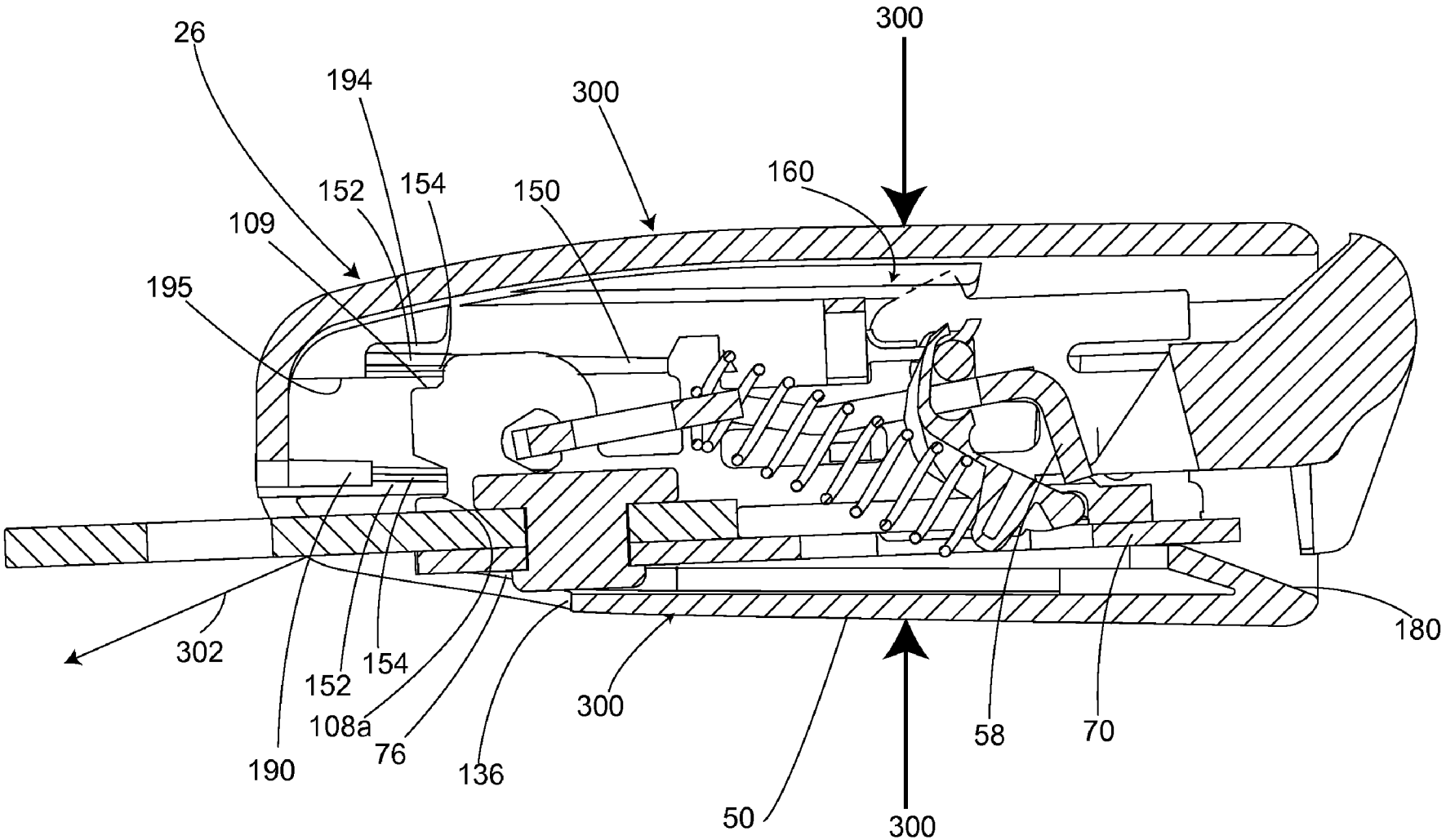
FIG. 6 shows the locking assembly of the present invention, partially engaged with the cover.

Reference is again made to FIG. 2 and also to FIG. 6. FIG. 2 shows the cover 26 spaced apart from a fully assembled locking assembly 22 and FIG. 6 shows the locking assembly (which includes frame 50) partially within the cover 26. During assembly of the locking assembly to the cover, the tongue is not secured to the locking assembly (which is shown in FIG. 2). Reference is briefly made to the arrows 300 in FIG. 6, which diagrammatically represent a holding fixture for the cover. Numeral 302 diagrammatically illustrates the resultant force on the locking assembly 22 during assembly. To assemble the locking assembly and cover, the locking assembly 22 is positioned adjacent opening 132 of the cover 26 with the cover held in place such as within the holding fixture or fixed in some other manner such as manually held. The strap 76 if used, or alternately the frame bottom (at the rear of the frame) is placed upon ramp 180, and the locking assembly 22 is pushed (or pulled) into the interior, hollow space 26*a* of the cover 26. As the frame 50, as well as the entire locking assembly 22, is moved (pushed or pulled) further into the cover 26, the rear portion 75 of each frame side 70*a* and 70*b* will engage one or both of the opposing sets of upper and lower spaced-apart oblique wall portions 150, which serves to center the frame within the cover as it is pushed further into the cover.

From the above figures, in the embodiment where the strap 76 is used, the strap 76 leads the frame 50 into the cover and passes under the lower ribs 154. As an aside, if the strap 76 engages one or more of the wall portions 150, this action will beneficially tend to center the strap in the cover. As the strap 76 is urged further into the cover, the strap will extend through the rear opening 136. The various parts of the buckle are dimensioned so that as the strap exits opening 136, the sides 70*a* and 70*b* of the frame 50 become positioned against and between the opposing inner ribs 154 of the axially extending opposing wall portions 152. Further, in this condition the locking features 100 are positioned at the beginning (forward end) of the alignment features 160. As the frame 50, as well as the entire locking assembly 22, is moved (pushed or pulled) further into the cover 26, it will engage and slide between the opposing inner ribs 154 located on either side of the cover. These opposed ribs provide side-to-side stability and guidance for the frame and guide the frame and strap (if used) into their final positions into the cover 26. As the frame is moved inwardly, the frame sides deform each rib 154 and as mentioned, are laterally stabilized by the axial wall section 152 of the cover 26.

As shown in the various figures such as for example FIGS. 1, 2 and 6, each locking feature 100 includes a barb 101 that is angled toward the front of the cover. Further inward motion of the frame 50, beyond the beginning of the features 160, causes each barb 101 to grab onto and deform the undersurface 120*a* of the top. More particularly, each barb 101 engages a corresponding flat ridge 162 and bites into it. FIG. 6 also shows one of the locking features 100 (barb 101) engaging a forward portion of ridge 162. As the frame is moved into the cover, the bottom of the frame slides upon the horizontal surface 184 of the ramp 180, which pushes the barbs 101 into the top of the cover displacing material of ridge 162. Continued inner motion of the frame 50 causes the frame sides to deform each rib 154 of each axial wall portion 152. Further inward motion of the frame 50 places each of the locking elements 100 between the ridges 162 and rigs 164. The ribs 164 serve to laterally position the forward part of the frame 50 within the cover.

The strap 76 is used when the buckle 26 is mounted directly to a supporting surface such as a frame of a vehicle seat. For those frames, such as 50*a* and 50*b* (see figures 3*a* and 3*b*) in which a cable or seat belt is respectively secured to the frame, the seat belt 51 or cable 55*a* is first positioned into the mouth 130 and through the rear opening 136; the frame 50*a* or 50*b* is initially positioned so that it is partially within the cover and the bottom of the frame is resting on the ramp 180. It is envisioned the cover will be secured or at least held in place and the belt or cable pulled through the cover (see arrow 302, which represents the resultant force on the belt or cable), moving the frame further into the cover in the manner similar to that described above.

As the frame 50 becomes fully seated within the cover 26, the angled surface 110 of groove 108*a* engages a corresponding guiding member 190. More particularly, the angle engagement surface 110 compressively engages and displaces material of the top surface of guiding member 190. This press-fit engagement prevents motion of the frame generally perpendicular to axis 144 relative to the cover in an up-and-down direction. As the frame 50 fully seats into the the cover 26, the rear portion of the cover 26 at the leg portion 198 (of upper guide feature 194) engages the rear 75 of the frame 50. This engagement further stabilizes the rear of frame 50 from moving perpendicular to axis 144. As frame 50 slides over ramp 180, the front edge 96 of the frame 50 becomes positioned behind the wall (shoulder) 186, thereby preventing the frame from moving out of the cover 26.

The principal, illustrated embodiment of the invention shows a frame 50 with one side 70*a* having a notch, groove or shoulder 109, as well as a groove 108*a* with a corresponding angled surface 110 at the rear of the frame, which provides a degree of dissymmetry in the structure of the rear of the frame and shows that only the set of grooves (notch, shoulder) 109, 109*a* and angle surface are needed. The side 70*b* can be made symmetrical to side 70*a*. In this manner groove 108*b* will also include an inclined surface such as 110*a* and side 70*b* will also include a shoulder (notch, groove) 109*a*, as shown in FIG. 5*e*.

As mentioned above, the forward direction of barbs 101 further prevents the forward (and aft) motion of the frame 50 relative to the cover 26, as any relative forward (or aft) motion will cause the barbs 101 to bite further into a corresponding ridge 162 located on undersurface of the top of the cover. Furthermore, the compressive loading of the barbs 101 prevents the forward part of the frame from moving perpendicular to axis 144 in a generally up-and-down fashion, as well as stabilizes the frame from moving perpendicular to axis 144 in a general side-to-side manner.

In view of the above features of the present invention, the one-piece, integrally formed cover provides for added strength in relation to a cover having separate upper and lower parts and is less susceptible to breaking as there are no artificial mating edges as in the case of the prior art. The integral features of the one-piece cover 26 provide a variety of stabilization features operating cooperatively with the frame to guide and hold the frame in place during and after assembly.

Many changes and modifications in the above-described embodiment of the invention can, of course, be carried out without departing from the scope thereof. Accordingly, that scope is intended to be limited only by the scope of the appended claims.

The invention claimed is:

1. A seat belt buckle assembly (20) comprising:

a locking assembly (22) comprising a frame with opposing generally parallel flat sides devoid of laterally extending tabs or bent-over formations, and an integrally formed, one-piece cover (26) to receive the locking assembly, the cover including a plurality of guiding and stabilizing members configured to guide the locking assembly into a preferred orientation within the cover as well as to prevent certain relative motion between the cover and the locking assembly;

wherein the cover includes at least one first guide (140) disposed symmetrically about a longitudinal central axis (144) of the cover, and extending inwardly from opposing sides of the cover and located closer to a rear of the cover than to a front of the cover and configured to receive the sides of the frame and to guide the frame into a preferred orientation relative to the central axis.

2. The seat belt buckle assembly (22) of claim 1 wherein the first guide (140) includes opposing shelf-like tapered portions (150) configured to receive and guide the frame and opposing straight portions (152) positioned rearward of the shelf-like tapered portions, the straight portions having spaced walls parallel to the central axis (144) for holding the frame in place.

3. The seat belt buckle assembly of claim 2 including upper and lower shelf-like, tapered portions and upper and lower straight portions.

4. The seat belt buckle assembly of claim 3 wherein each straight portion includes a deformable rib (154) for holding an upper or lower portion of a side of the frame.

5. The seat belt buckle assembly of claim 2 wherein the straight portions include a deformable rib (154) deforming on contact with a frame side for holding a side of the frame.

6. The seat belt assembly of claim 2 wherein the frame (50) includes an interfering formation (100, 101) formed on a top portion of each side of the frame for engaging an underside portion of a top of the cover and wherein the frame and the cover are configured so that the frame is first received in the straight portion prior to engagement of the interfering formation with the underside of the top of the cover.

7. The seat belt buckle assembly (20) of claim 1 wherein the frame (50) includes an interfering formation (100, 101) formed on a top portion of each side of the frame for engaging an underside portion of a top of the cover.

8. The seat belt assembly (20) of claim 7 wherein the cover, on the underside of the top, includes a cooperating formation (160) for guiding and for receiving the interfering portion (100, 101) of the frame.

9. The seat belt assembly (20) of claim 1 wherein at least one of the sides (70*a*, 70*b*) of the frame (50) at a top rear region of the one side includes a notch, groove or shoulder (109) and wherein the cover (26) includes a receiving structure (194, 198) configured to receive the notch, groove or shoulder (109) and prevent upward motion of the side of the frame.

10. The seat belt assembly (20) of claim 9 wherein each rear end of a side of the frame at a top rear region includes a notch, groove or shoulder (109, 109*a*) and wherein the cover includes a plurality of receiving structures for holding the respective ends of the sides of the frame in place.

11. The seat belt assembly of claim 1 wherein the frame (50), proximate a rear end (106) of one of the sides (70*a*, 70*b*), includes a groove (108*a*) having a tapered top surface and wherein the cover includes at least one guide feature (190) projecting from a rear of the cover, wherein upon insertion of the frame into the cover the tapered top surface interferes with the projecting guide (190).

12. A seat belt buckle assembly (20) comprising:

a locking assembly (22) and an integrally formed, one-piece cover (26) to receive the locking assembly, the cover including a plurality of guiding and stabilizing members configured to guide the locking assembly into a preferred orientation within the cover as well as to prevent certain relative motion between the cover and the locking assembly;

wherein the locking assembly (22) includes a frame (50) having sides (70*a*, 70*b*), and wherein the cover includes at least one first guide (140) disposed about a longitudinal central axis (144) of the cover, configured to receive the frame and to guide the frame into a preferred orientation relative to the central axis;

wherein the frame (50) includes an interfering formation (100, 101) formed on a top portion of each side of the frame for engaging an underside portion of a top of the cover; and wherein the cooperating formation includes opposingly spaced flat ridges (162) depending from the top of the cover and configured to interfere with the interfering formation and opposingly spaced ribs configured to guide a respective one of the interfering formations relative to the central axis (144).

13. The seat belt assembly (20) of claim 12 wherein the interfering formation is configured to deform and interfere with the flat ridges on insertion of the frame into the cover.

14. A seat belt buckle assembly (20) comprising:

a locking assembly (22) comprising a frame with opposing generally parallel flat sides devoid of extending tabs or bent formations, and a flat bottom, the frame at a front portion thereof including a flat tab extending forward of the frame sides forming, in cooperation with the bottom, a pair of opposing shoulders, one shoulder on either side of the flat tab, and an integrally formed, one-piece cover (26) to receive the locking assembly, the cover including side walls, a bottom and top and a open mouth, the cover further including a plurality of guiding and stabilizing members configured to guide the locking assembly into a preferred orientation within the cover as well as to prevent certain relative motion between the cover and the locking assembly, the one-piece cover additionally including an entrance ramp, the ramp having a ramp surface located at the open mouth, extending rearward of the open mouth and upward from the bottom, the ramp having side walls spaced from the cover side walls, the ramp surface terminating in a vertically extending wall which extends to the bottom, the ramp including side walls and each positioned rearward of the vertically extending wall forming a notch or shoulder for receipt of one of the shoulders of the flat tab;

with the frame in place within the cover the flat tab abuts the vertically extending wall preventing forward motion of the frame through the open mouth and each one of the opposing shoulders of the flat tab is received within one of the notches or shoulders of the ramp preventing sideways motion of the frame relative to the cover.

15. A seat belt buckle assembly (20) comprising:

a locking assembly (22) having a frame (50); and an integrally formed, one-piece cover (26) to receive the locking assembly, the cover and frame including a plurality of guiding and stabilizing members configured to guide the frame into a preferred orientation within the cover as well as to prevent certain relative motion between the cover and the locking assembly wherein the guiding and stabilizing members include: a centering guide member (140) for urging the frame toward a central axis of the cover, an interfering member depending from an underside surface of the top of the cover for interfering with a projecting member located on the top of a frame side, which prevents forward motion of the frame relative to the cover, a groove in a top portion of the frame configured to interfere with a mating cover member located on the underside of the cover proximate a rear portion of the cover and a stabilizing groove located on a rear portion of the frame configured to interfere with a horizontally extending portion of the cover.

* * * * *